US006899421B2

(12) United States Patent
Taguchi et al.

(10) Patent No.: US 6,899,421 B2
(45) Date of Patent: May 31, 2005

(54) PLATEN AND INKJET RECORDING APPARATUS HAVING THAT PLATEN

(75) Inventors: Akihiro Taguchi, Yokohama (JP); Hiroaki Arakawa, Uenohara (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/648,546

(22) Filed: Aug. 25, 2003

(65) Prior Publication Data

US 2004/0046829 A1 Mar. 11, 2004

(30) Foreign Application Priority Data

Sep. 5, 2002 (JP) ..... 2002-259666
Sep. 20, 2002 (JP) ..... 2002-274302

(51) Int. Cl.[7] ..... B41J 2/01
(52) U.S. Cl. ..... 347/104; 347/89; 347/90
(58) Field of Search ..... 347/89, 90, 104

(56) References Cited

U.S. PATENT DOCUMENTS 5,717,446 A * 2/1998 Teumer et al. ..... 347/35
6,239,817 B1 * 5/2001 Meyer ..... 347/36
6,511,144 B2 * 1/2003 Otsuki ..... 347/12
6,729,720 B2 * 5/2004 Miki et al. ..... 347/104

* cited by examiner

*Primary Examiner*—Daniel J. Colilla
*Assistant Examiner*—Jill E. Culler
(74) *Attorney, Agent, or Firm*—Squire, Sanders & Dempsey

(57) ABSTRACT

A platen on which a recording medium advances, of an inkjet recording apparatus, having:

a grooved section formed in a direction perpendicular to a feeding direction of the recording medium on the platen, to receive oversprayed ink jetted onto the recording medium form a recording head; and a supporting member which moves up to a supporting position and supports the recording medium when the recording medium crosses over the grooved section, wherein the supporting member prevents the recording medium from falling into the grooved section and maintains a stable distance between the recording medium and the recording head.

14 Claims, 17 Drawing Sheets

PLATEN AND INKJET RECORDING APPARATUS HAVING THAT PLATEN

BACKGROUND OF THE INVENTION

The present invention relates to structure of a platen on which a grooved section for receiving oversprayed ink is formed and of an inkjet recording apparatus having that platen.

Conventional structure of an inkjet recording apparatus features:

a recording head having a plural array of nozzle, positioned on the plane facing a recording medium such as a printing sheet, to jet ink onto the recording medium, a platen to define the position of the recording medium in relation to the recording head, and for supporting the recording medium from beneath, a control section to control the recording head, and in particular, to control the scanning movement of the recording head, as well as to control the injection of inkjet, and a conveyance device to transport the recording medium. That is, recording onto the recording medium is achieved by ink ejected from the nozzle arrays under the condition that the recording medium is supported on the surface of the plane platen facing the recording head.

Concerning the structure of the inkjet recording apparatus which can produce a borderless print having no white margins, that is, a print without a border on the recording medium, there is structure wherein an grooved section is formed on the surface of the platen (see Japanese Patent document 1)

Japanese patent document 1 TOKKAIHEI 2000-289275, (paragraphs [0022]-[0027], [0029]-[0039], and FIG. 4).

FIG. 9 is a sectional view showing the structure of conventional inkjet recording apparatus wherein an grooved section is formed on the surface of the platen.

As shown in FIG. 9(*a*), the structure of the present inkjet recording apparatus is composed of platen 2, conveyance device 4 installed to transport the recording medium on the surface of platen 2, and recording head 3 to let an ink to the surface of the recording medium.

Further, in the surface of platen 2 facing recording head 3, grooved section 21 is formed based on the position of recording head 3. In order to make a borderless print on a leading edge of the recording medium, grooved section 21 is positively formed on the surface of platen 2, and is formed at the area corresponding to at least the scanning range of recording head 3. When a print without a white margin is made on the recording medium without formation of grooved section 21, ink is ejected and sprayed beyond the edge of the recording medium, being printed on the surface of platen 2, whereupon the back surface of the recording medium comes into contact with ink, resulting in a stained back surface of the recording medium. Accordingly, by forming grooved section 21 in the surface of platen 2 and throwing the ink in grooved section 21 as shown in FIG. 9(*a*), ink spots on the surface of platen 2 and the back surface of the recording medium are greatly reduced.

However, there have been the following problems in conventional inkjet recording apparatus.

In cases that the end of the recording medium passes over the grooved section, when ink is ejected onto the leading edge of the recording medium which overhangs from the upstream edge of the grooved section, as shown in FIG. 9(*b*), rigidity of the end of the recording medium is reduced so that a phenomenon occurs wherein the end of the recording medium drops down.

Further, in order to reduce the scanning path of the recording head, the recording head becomes large, and therefore, the grooved section is also large, resulting in the phenomenon wherein the end of the recording medium falls down in the grooved section. When the end of the recording medium falls down, the end of the recording medium enters the grooved section, causing a paper jam, and further, the position of the recording medium is not firmly supported where it faces the nozzle array so that distance (PG) between the recording head and the recording medium is not constant, resulting in deterioration of print quality. Further, there is a tendency that these problems happen frequently because of a remaining curl, especially when the recording medium is a sheet from a paper roll.

In the prevention described in the above-mentioned patent document 1, the above-mentioned falling phenomenon into the grooved section (that is, a pit) is prevented by a wire which is turned around a main body. Since the wire is installed in such a way that the recording medium is carried to a sloping section which is formed on the end face in the recording medium feeding direction on the grooved section, but even though the falling phenomenon into the grooved section is prevented, distance (PG) between the recording head and the recording medium does not remain constant.

SUMMARY OF THE INVENTION

The present invention is presented in view of the above-stated problems in the conventional technology, and the objective of the invention is to provide a platen, and an inkjet recording apparatus having a platen on which a grooved section is formed, wherein the end of the recording medium is not jammed in the grooved section when the end of the recording medium passes over the grooved section, and also the distance between the recording head and the recording medium is kept as constant as possible.

The above objective is attained by any one of the structures stated below.

Structure 1

A platen which is structured to face a recording head which scans perpendicular to the recording medium feeding direction, and jets ink onto the recording surface of the recording medium, and has an grooved section on the platen surface for receiving oversprayed ink, wherein a notched section is formed in an inner wall surface of the grooved section, in a depth direction to the grooved section, and also a supporting member, which moves to cover at least a part of the grooved section and supports the end of the recording medium, is provided in the notched section.

By the structure mentioned above, when the recording medium passes on the platen, the leading end of the recording medium which is downstream of the feeding direction, does not fall in the grooved section, and further the distance between the recording head and the recording medium remains as constant as possible.

Structure 2

The platen stated in structure 1, wherein the notched section is cut into the surface of the above mentioned platen facing the recording head.

By the structure mentioned above, since the edge of the grooved section, located downstream in the feeding direction, is formed irregularly, the recording medium does not fall into the grooved section, and is fed smoothly. Since the surface facing the recording head is a surface of the platen, the notched section forms an opened shape on the surface of the platen.

Structure 3

The platen stated in structure 2, when the supporting member moves to a recording medium supporting position, the supporting member projects slightly above the surface facing the recording head.

By the structure mentioned above, while supporting the recording medium from beneath, the supporting member securely sends the recording medium from the upstream edge of the grooved section to the downstream edge of the grooved section, and thereby preventing occurrence of jams of the recording medium caused by falling into the grooved section.

Structure 4

The platen stated in any one of structures. 1–3, wherein the notched section is formed in an inner wall which exists on the recording medium feeding direction side of the grooved section.

By the structure mentioned above, even though a curl may remain at the end of the recording medium, that is, at the leading edge of the recording medium, the supporting member securely supports the recording medium from beneath so that the recording medium does not fall into the grooved section and is fed accurately across the platen.

Structure 5

The platen stated in any one of structures 1–4, wherein an stray ink absorbing member is provided at the bottom of the grooved section to absorb oversprayed ink.

By the structure mentioned above, the stray ink absorbing member effectively absorbs any oversprayed ink in the grooved section, to prevent the supporting member provided in the grooved section, from being spotted by stray ink.

Structure 6

An inkjet recording apparatus, composed of a recording head which scans in the direction perpendicular to the recording medium feeding direction, and jets ink onto the recording surface of the recording medium, and a platen which faces the recording head and has the grooved section for receiving oversprayed ink, wherein a deep notched section is formed in an inner wall surface of the grooved section, in a depth direction of the grooved section, and a supporting member is provided in the notched section, which moves to cover at least a part of the grooved section and supports the end of the recording medium.

By the structure mentioned above, when the recording medium passes on the platen, the leading end of the recording medium which is downstream of the feeding direction, does not fall into the grooved section, and further the distance between the recording head and the recording medium remains as constant as possible.

Structure 7

The inkjet recording apparatus stated in structure 6, wherein the notched section is cut into the surface of the above mentioned platen facing the recording head.

By the structure mentioned above, since the edge of the grooved section, located downstream in the feeding direction, is formed irregularly, the recording medium does not fall into the grooved section, and is fed smoothly.

Structure 8

The inkjet recording apparatus stated in structure 7, when the supporting member moves to a recording medium supporting position, the supporting member projects slightly above the surface facing the recording head.

By the structure mentioned above, while supporting the recording medium from beneath, the supporting member securely sends the recording medium from the upstream edge of the grooved section to the downstream edge of the grooved section, and thereby preventing occurrence of jams of the recording medium caused by falling Into the grooved section.

Structure 9

The inkjet recording apparatus stated in any one of structures 6–8, wherein the notched section is formed in an inner wall which exists on the recording medium feeding direction side of the grooved section.

By the structure mentioned above, even though a curl may remain at the end of the recording medium, that is, at the leading edge of the recording medium, the supporting member securely supports the recording medium from beneath so that the recording medium does not fall into the grooved section and is fed accurately across the platen.

Structure 10

The inkjet recording apparatus described in any one of structures 6–9, is further composed of a first sensor to detect completion of a borderless printing work on the leading edge of the recording medium, a second sensor to detect the trailing edge of the recording medium, and a control section to control movement of the supporting member, based on detected results of the first and second sensors.

By the above structure, the supporting member does not become dirty due to the ink jetted from the recording head, and thereby it is possible to support and convey the recording medium having no stray ink spots on its rear surface. Here, the first sensor to detect completion of a borderless print which is printed on the leading edge of the recording medium, mentioned above, is a sensor which allows the supporting member to close the grooved section, based on completion of the borderless print on the leading edge of the recording medium. In other words, this sensor is a sensor to control the supporting member, which determines the timing to start a closing control of the grooved section. The above-mentioned control section controls the supporting member to close the grooved section, by receiving the detection signal of the recording medium from the first sensor.

When the borderless printing is conducted on the trailing edge of the recording medium, the second sensor detects the trailing edge of the recording medium as mentioned above, functioning as a sensor to signal the supporting member to retract into the notched section, thereby, preventing the supporting member from being subjected to stray ink. Accordingly the second sensor is a supporting member control sensor which determines the timing of retraction of the supporting member in the notched section, and therefore the control section controls the standby status of the supporting member in the notched section, based on detection of the recording medium by the second sensor.

Structure 11

The inkjet recording apparatus stated in any one of structures 6–9, wherein the supporting member moves to close at least a part of the grooved section, before the start of the conveyance of the recording medium on the platen, and also retracts back into the notched section not to close the grooved section, after completion of the conveyance of the recording medium.

By the structure mentioned above, it is possible to prevent the supporting member from being stained by oversprayed ink jetted from the recording head, and further to prevent the rear surface of the recording medium from being spotted by the stray ink on the supporting member. Further, the projected section of the supporting member pushes the recording medium up, without adverse influence on the images, and further the recording medium is supported at proper timing and is transported precisely.

Structure 12

The inkjet recording apparatus of any one of structures 6–11, in which provided is a stray ink absorbing member which absorbs the oversprayed ink at the bottom of the grooved section.

By the structure mentioned above, the stray ink absorbing member effectively absorbs the ink oversprayed into the grooved section, and thereby it is possible to prevent the supporting member from being spotted by stray ink.

Structure 13

The inkjet recording apparatus, composed of a recording head which scans perpendicular to the recording medium feeding direction, and jets ink onto the recording surface of the recording medium, and the platen which faces the recording head and has a grooved section for receiving oversprayed ink, wherein the grooved section is composed of two or more small grooved sections having an unmovable solid supporting member between them, and the two grooved sections are arranged parallel to each other perpendicular to the feeding direction of the recording medium, and further the fixed supporting member or the surface of the platen is positioned in the feeding direction side of the small grooved sections, and wherein a control section controls the recording head to jet the ink, based on the area in which the stray ink absorbing member exists.

By the structure mentioned above, the recording medium is supported by the fixed supporting member, and thereby the leading end of the recording medium does not fall into the small grooved sections, and further the distance between the recording head and the recording medium remains as constant as possible.

Structure 14

The inkjet recording apparatus, composed of a recording head which scans perpendicular to the recording medium feeding direction, and jets ink onto the recording surface of the recording medium, and the platen which faces the recording head and has a grooved section for receiving oversprayed ink, wherein the grooved section is composed of a first small grooved section array, consisting of more than two first small grooved sections at a predetermined interval in the scanning direction of the recording head, and a second small grooved section array, consisting of more than two second small grooved sections whose lengths in the scanning direction of the recording head are greater than the length of the above-mentioned interval, wherein the first small grooved section array is parallel to the second small grooved section array, and the second small grooved section connects both the adjacent first small grooved sections, and wherein fixed supporting member is arranged between the first small grooved sections, and is also arranged between the second small grooved sections, and wherein the control section controls the recording head to eject ink in accordance with the area of the stray ink absorbing section.

By the structure mentioned above, since the downstream surface of the grooved section is formed by cutting into the surface of the platen, when the recording medium passes on the platen, the leading edge of the recording medium does not drop into any of the grooved sections, and further it is possible to maintain a stable distance between the recording head and the recording medium.

Structure 15

The inkjet recoding apparatus in structures 13 and 14, wherein the ink absorbing sections are installed in a such way that the sides of the ink absorbing sections in the connected first and second small grooved sections, which are perpendicular to the scanning direction of the recording head, are collinear in the feeding direction of the recording medium.

By this structure, ink ejected from the nozzle array of the recording head can be exclusively targeted onto the ink absorbing section, and therefore, a print is precisely produced on the recording surface of the recording medium without any unevenness.

Structure 16

The inkjet recording apparatus in structures 13–15, wherein the ink absorbing sections are connected each other.

Such structure can make the range for installing the ink absorbing sections wide, and thereby the oversprayed ink can be effectively absorbed.

BRIEF DESCRIPTION OF THE DRAWINGS

FIG. 13(*b*) is a block diagram showing the relationship among the sensors, the control section, and the recording head.

DETAILED DESCRIPTION OF THE PREFERRED EMBODIMENT

Figure 1:
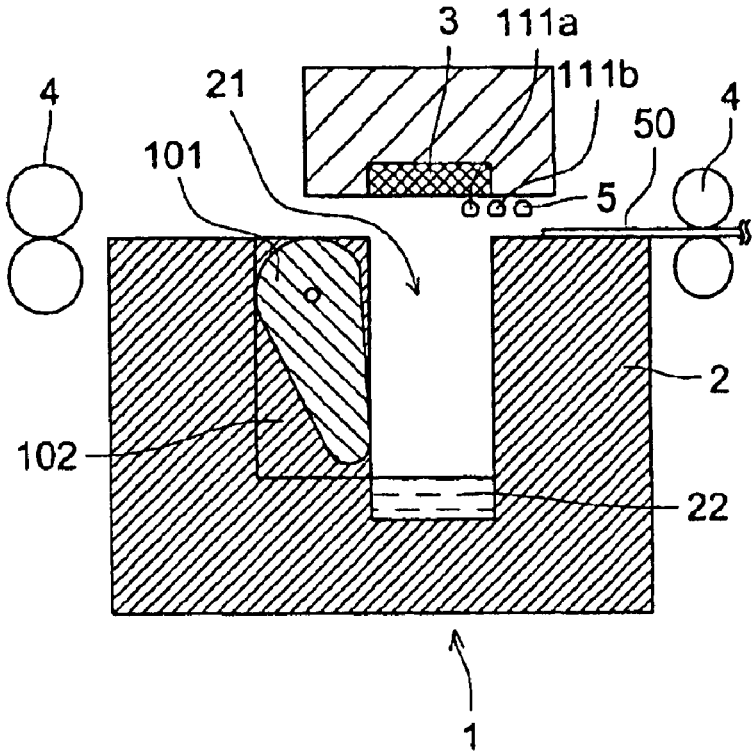
FIG. 1 is a sectional view showing the structure of the first embodiment of the inkjet recording apparatus of the present invention.

The embodiment of the present invention will be described referring to the drawings.

(The First Embodiment)

FIG. 1 is a sectional view showing a structure of the first embodiment of the inkjet recording apparatus of the present invention.

As shown in FIG. 1, inkjet recording apparatus 1 of the present invention is composed of feeding device 4 to feed recording medium 50, recording head 3 which moves in parallel to the recording surface of recording medium 50 and is perpendicular to the feeding direction of recording medium 50, and recording head 3 which jets the ink onto the recording surface of recording medium 50, and platen 2 having grooved section 21 on the surface facing recording head 3 for receiving the ink, and establishing the position of recording medium 50.

Inkjet recording apparatus 1 of the present invention is further composed of print starting sensor 5 to start the borderless printing on recording medium 50. Specifically print starting sensor 5 is installed at a position to enable detection of recording medium 50 which just before it arrives at grooved section 21, and the detected result by print starting sensor 5 is transmitted to a control device (not illustrated) which controls recording head 3, and thereby the ink ejection onto the recording surface of recording medium 50 is started.

In the embodiments of the platen and the inkjet recording apparatus using said platen of the present invention, the direction toward which the recording medium is fed is referred to as the downstream direction (or the downstream side) in the explanations, while the direction from which the recording medium is fed, is referred to as the upstream direction (or the upstream side).

Notched section 102 is formed in the direction to the depth of grooved section 21, on the end face of the downstream side of grooved section 21. Rotatable supporting member 101 which supports recording medium 50 is provided in notched section 102 to fill at least a part of grooved section 21. Since rotatable supporting member 101 is serviceable as long as it fills only a part of grooved section 21 as mentioned above, only one piece of rotatable supporting member 101 may be formed to fill grooved section 21, or a plurality of rotatable supporting members 101 may be formed.

In order not to disrupt the movement of rotatable supporting member 101, stray ink absorbing member 22 is provided to absorb the oversprayed ink at the bottom of grooved section 21. If grooved section 21 is formed without a bottom, stray ink absorbing member 22 can be formed as the bottom of grooved section 21.

Rotatable supporting member 101 is connected to a control section (not illustrated) which controls the movement of rotatable supporting member 101, and the control section is connected to rotatable supporting member first control sensor 111*a* (hereinafter referred to as first sensor 111*a*) which detects the completion of borderless printing on the downstream side (that is, the leading edge) of recording medium 50, and rotatable supporting member second sensor 111*b* (hereinafter referred to as second sensor 111*b*) which detects the start of borderless printing on the upstream side (that is, the trailing edge) of recording medium 50. That is, first sensor 111*a* is arranged at the position on which it is possible to detect the completion of the borderless print on the leading edge of recording medium 50 which is fed based on the installed position of recording head 3, and thereafter, by receiving the detection signal from first sensor 111*a*, the above-mentioned control section forces rotatable supporting member 101 to support recording medium 50.

Accordingly, in the embodiment of the inkjet recording apparatus of the present invention, rotatable supporting member 101 is stored in notched section 102, during an interval between the time when print starting sensor 5 detects recording medium 50 and the time when first sensor 111*a* detects the completion of the borderless printing on the leading edge of recording medium 50. This is because if the jetted ink from the recording head to the recording surface of recording medium 50 is marked on rotatable supporting member 101, the reverse side of the recording medium becomes dirty when rotatable supporting member 101 supports recording medium 50, and these stray marks must be prevented.

Further, second sensor 111*b* is arranged at the position at which it is possible to detect the start of borderless printing on the trailing edge of recording medium 50 which is fed based on the installed position of recording head 3. Specifically, second sensor 111*b* is arranged at the position where it is possible to detect the arrival of the upstream edge (that is, the trailing edge) of recording medium 50 at the top section of rotatable supporting member 101. The above-stated control section controls rotatable supporting member 101 to be stored in notched section 102, by receiving the detection signal from second sensor 111*b* installed at the position mentioned above.

Next, the platen provided in the inkjet recording apparatus of the present invention will be explained, while referring to the drawings.

Figure 2:
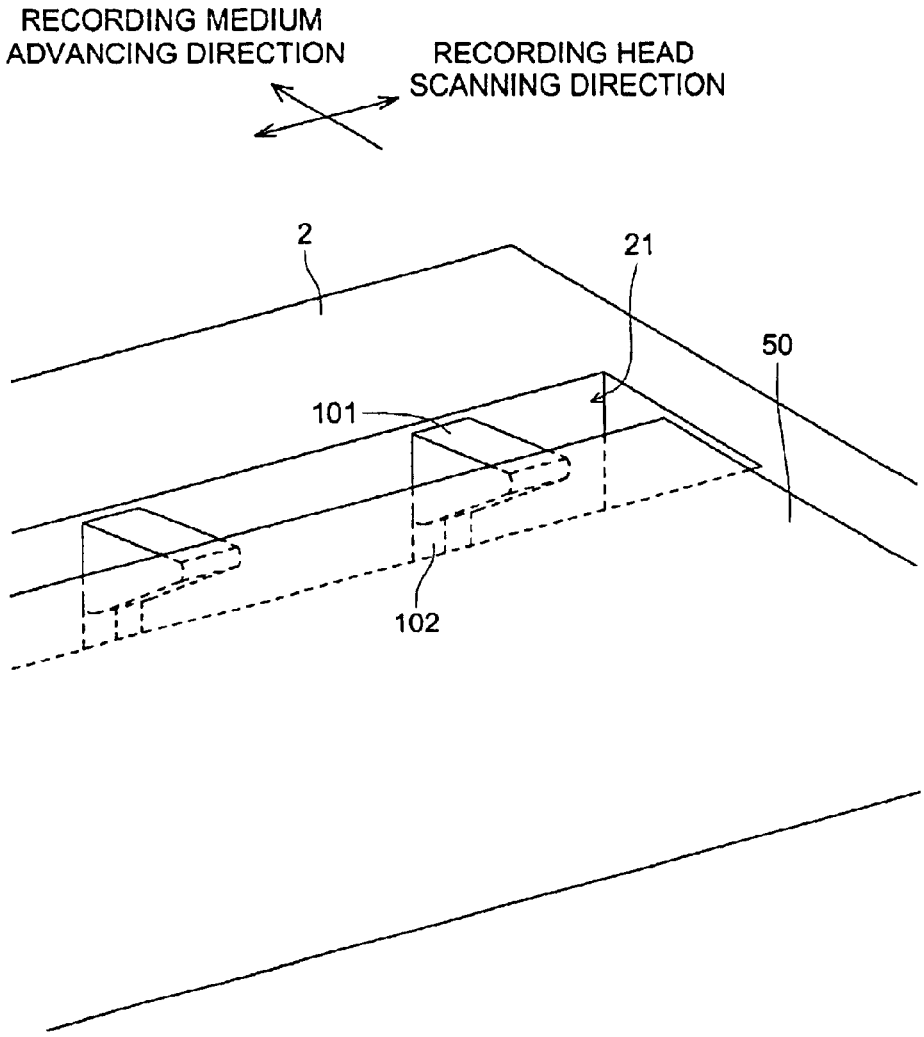
FIG. 2 is a perspective view of the platen of the first embodiment of the present invention.
Figure 3:
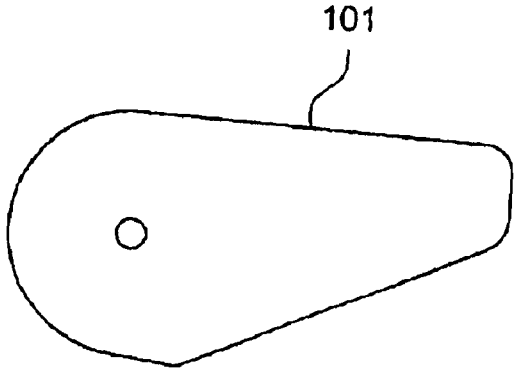
FIG. 3 is a sectional view of the rotatable supporting member of the first embodiment of the present invention.

FIG. 2 is a perspective view showing the structure of the surface of the platen of the first embodiment of the present invention, while FIG. 3 is a sectional view showing the structure of the rotatable supporting member of the first embodiment of the present invention.

As shown in FIG. 2, at the end face on the downstream side of grooved section 21 formed on the surface of platen 2, as seen from the feeding direction of recording medium 50, notched section 102 is formed to face in the open direction of grooved section 21.

Further as shown in FIG. 2, in notched section 102, there is stored rotatable supporting member 101 whose form is triangular prism being capable of axial rotation. When rotatable supporting member 101 rotates toward the open direction of grooved section 21, the downstream edge of recording medium 50, traveling over grooved section 21, is supported by rotatable supporting member 101 from beneath.

The position where rotatable supporting member 101 supports recording medium 50 after rotation, is preferably slightly higher than the surface of platen 2, within the limit of not adversely influencing printing.

Still further, notched section 102 can penetrate through the surface of platen 2, as in the first embodiment of the present invention. By the penetration of notched section 102 through the surface of platen 2, the end face on the downstream side of grooved section 21, in the feeding direction of recording medium 50, forms an indented surface, which can prevent recording medium 50 from falling into grooved section 21.

Next, the operation of the first embodiment of the present invention will be explained, referring to the drawings.

Figure 4:
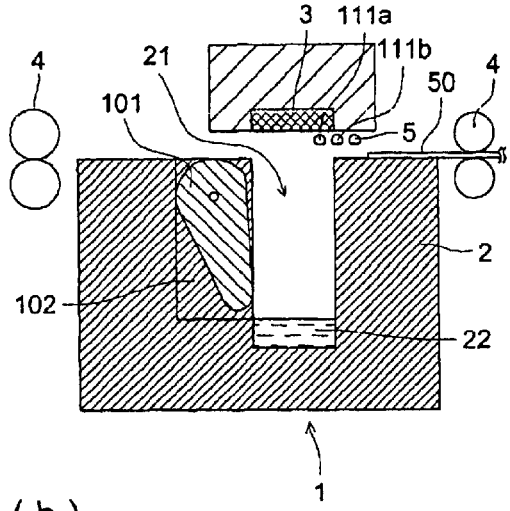
FIGS. 4(*a*)–4(*c*) are sectional views showing stages of movement of the first embodiment of the inkjet recording apparatus of the present invention.
Figure 4:
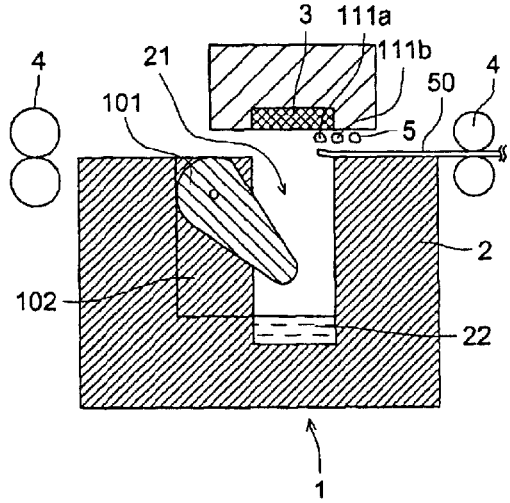
Figure 4:
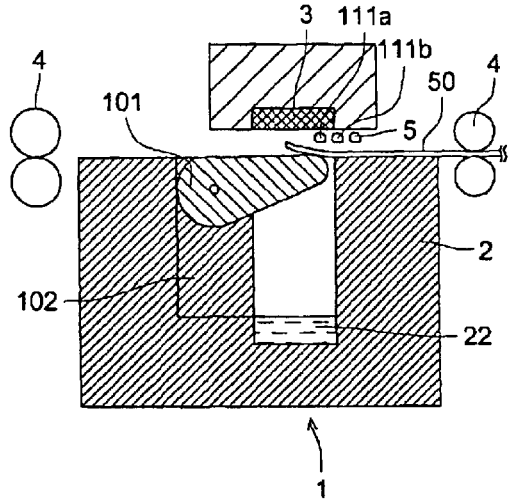

FIGS. 4(*a*)–4(*c*) are sectional views showing operation of the first embodiment of the present invention.

Initially, when recording medium 50 is fed from the upstream side on platen 2 and print starting sensor 5 detects recording medium 50, recording head 3 starts to jet the ink onto the recording surface of recording medium 50.

Then as shown in FIG. 4(*a*), rotatable supporting member 101 is stored in notched section 102, until fed recording medium 50 arrives at the position where recording medium 50 is detected by first sensor 111*a*.

Next, as shown in FIG. 4(*b*), when first sensor 111*a* detects the completion of the borderless printing by ink ejected from recording head 3 onto the recording surface, specifically the leading edge, of recording medium 50, the control section receives the detection signal from first sensor 111*a*, and controls rotatable supporting member 101 to rotate out of notched section 102. As stated above, allowing the leading edge of recording medium 50 not to fall into the grooved section 21, rotatable supporting member 101 supports recording medium 50, and works as a bridge in such a way that the leading edge can smoothly arrive at the surface of platen 2 located at the downstream side of grooved section 21. That is, rotatable supporting member 101 supports recording medium 50 from beneath until recording medium 50 arrives at the downstream end of grooved section 21.

Next as shown in FIG. 4(*c*), rotatable supporting member 101 supports the rear surface of recording medium 50 which is advancing, while recording head 3 ejects ink onto the recording surface of recording medium 50.

After that the print is performed by the ink ejected from recording head 3 to the upstream side edge (that is, the trailing edge) of recording medium 50, and when borderless printing is performed on the trailing edge of recording medium 50, the control section controls rotatable supporting member 101 to be stored in notched section 102, based on the detected result of second sensor 111*b*, and the print is completed. The position of second sensor 111*b* is such that rotatable supporting member 101 is not exposed to the oversprayed ink during the borderless printing work on the trailing edge of recording medium 50.

As stated above, according to the platen and the inkjet recording apparatus of the present embodiment, since a rotatable supporting member is provided to support the recording medium, when the recording medium travels on the platen, the leading edge of the recording medium does not drop into the grooved section, and further it is possible to keep the distance between the recording head and the recording medium stable.

Further, according to the platen and the inkjet recording apparatus of the present embodiment, since there are provided sensors for controlling the supporting member such as the first sensor to detect the completion of the borderless printing work on the leading edge of the recording medium and the second sensor to detect the trailing edge of the recording medium, and control section for controlling the movement of the rotatable supporting member based on the detected results, rotatable supporting member is not inked by oversprayed ink, and as a result it is possible to solve the problem of the recording medium becoming dirty.

(The Second Embodiment)

The second embodiment of the present invention will now be explained, while referring to the drawings. The explanation of the second embodiment having similar structure as that of the first embodiment described above will be eliminated.

Figure 5:
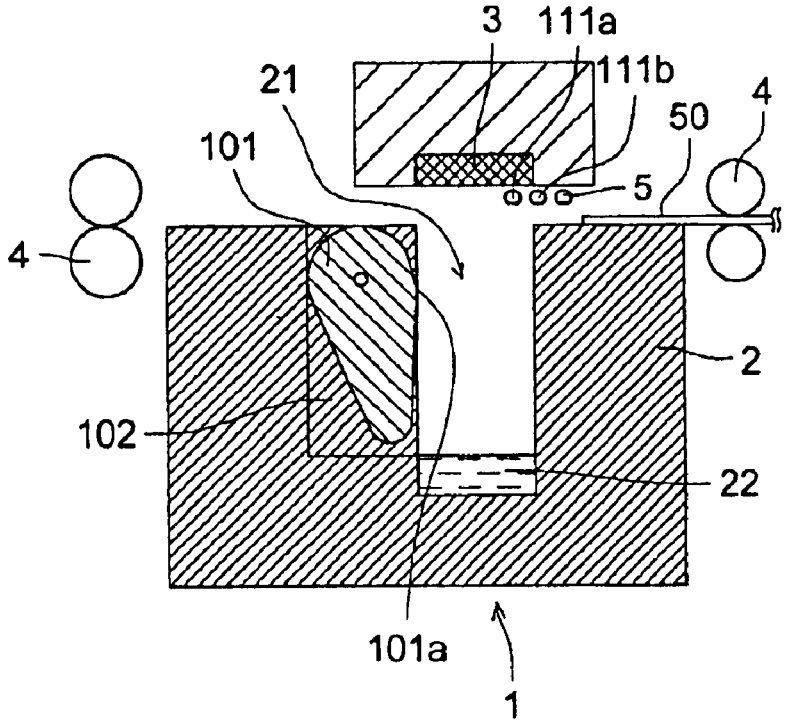
FIG. 5 is a sectional view showing the structure of the second embodiment of the inkjet recording apparatus of the present invention.
Figure 6:
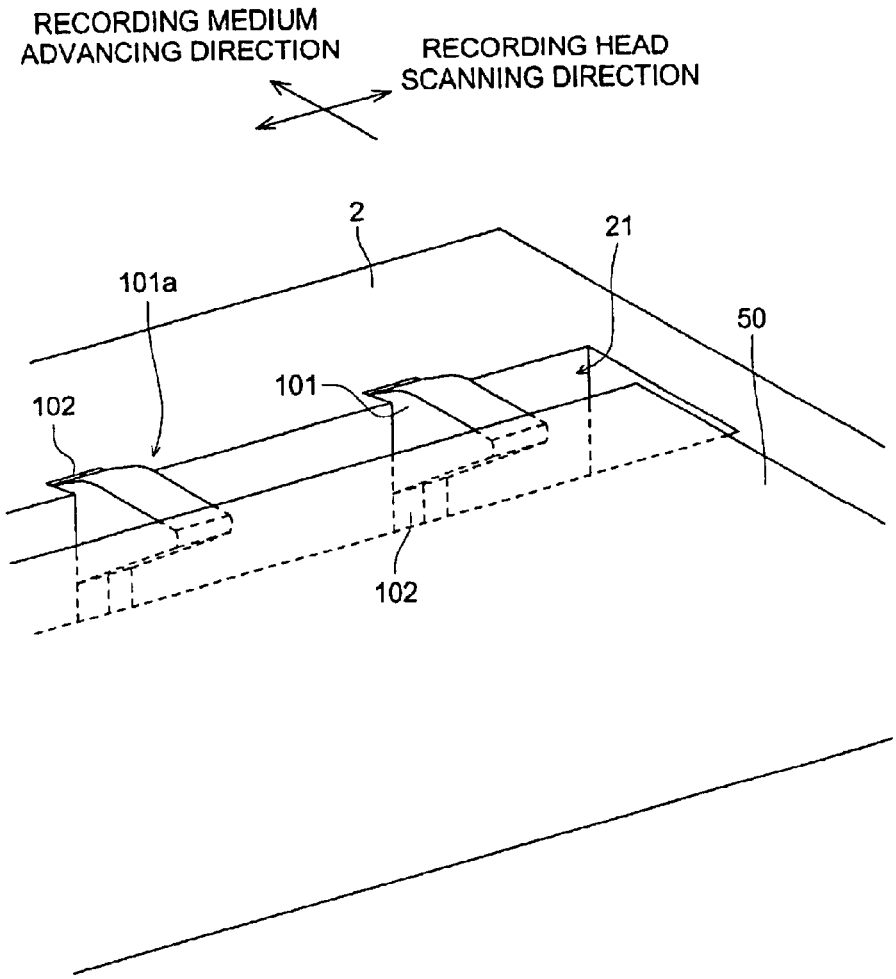
FIG. 6 is a perspective view of the platen of the second embodiment of the inkjet recording apparatus of the present invention.
Figure 7:
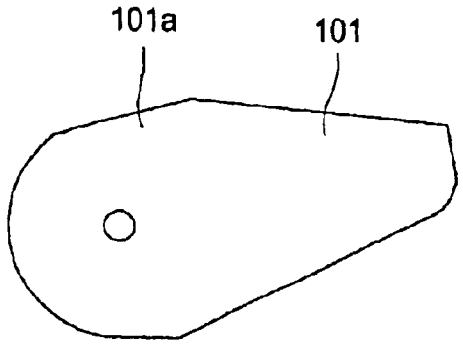
FIG. 7 is a sectional view showing the structure of the rotatable supporting member of the second embodiment of the inkjet recording apparatus of the present invention.

FIG. 5 is a sectional view showing the structure of the second embodiment of the inkjet recording apparatus of the present invention, while FIG. 6 is a perspective view of a platen of a second embodiment of the present invention. FIG. 7 is a sectional view showing the structure of the rotatable supporting member of the second embodiment of the present invention.

As shown in FIGS. 5 and 7, the structure of the second embodiment differs from that of the first embodiment in that projecting section 101*a* is formed on rotatable supporting member 101 and thereby the form of notched section 102 is changed. Specifically as shown in FIG. 6, notched section 102, existing on the downstream side edge of grooved section 21, is formed by cutting into the surface of platen 2. Since recording medium 50 is supported, projecting section 101*a* rises above the surface of rotatable supporting member 101, facing recording head 3, which provides a slightly higher surface for supporting recording medium 50. That is, in the present embodiment, the reason why notched section 102 is formed by cutting into the surface of platen 2, is that when rotatable supporting member 101, having been stored in notched section 102, moves and supports recording medium 50, projecting section 101*a* is allowed to project above the surface of platen 2. In this embodiment, projecting section 101*a* is formed such that the projected portion appearing above the surface of platen 2 has no noticeable effect on the printed work.

By this structure, recording medium 50, supported by projecting section 101*a* of supporting member 101, can smoothly and precisely arrive at the surface of platen 2 located at the downstream side.

Next, the operation of the second embodiment of the present invention will be explained while referring to FIGS. 8(*a*)–8(*c*).

Initially, when recording medium 50 is fed from the upstream side on platen 2 and print starting sensor 5 detects recording medium 50, recording head 3 starts to jet the ink onto the recording surface of recording medium 50.

Figure 8:
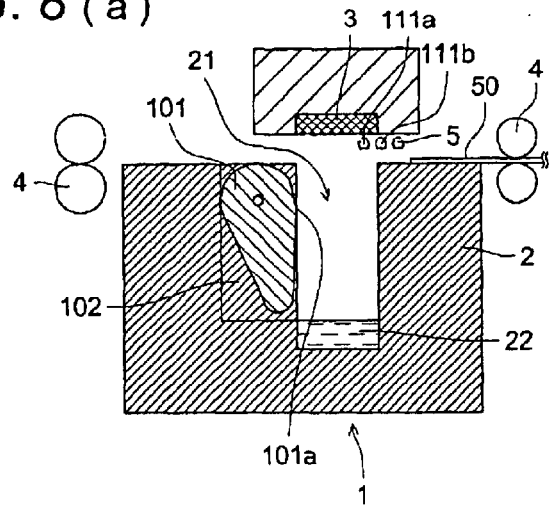
FIGS. 8(*a*)–8(*c*) are sectional views showing stages of movement of the second embodiment of the inkjet recording apparatus of the present invention.
Figure 8:
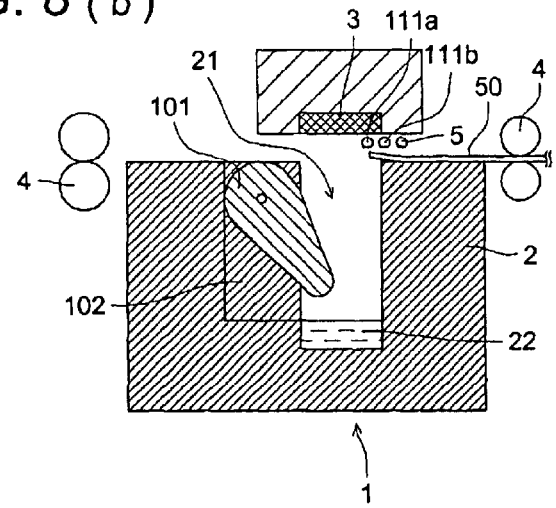
Figure 8:
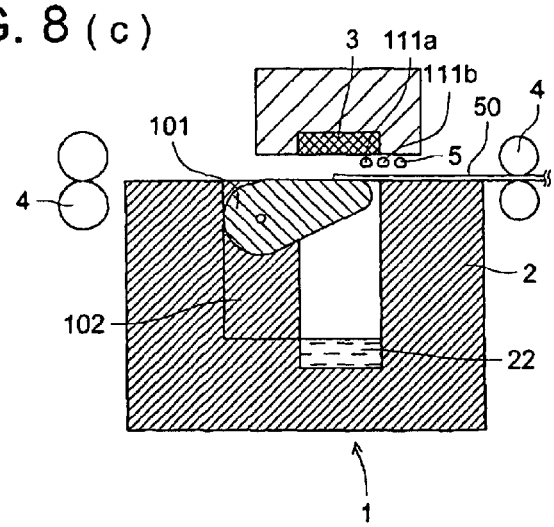
Figure 9A:
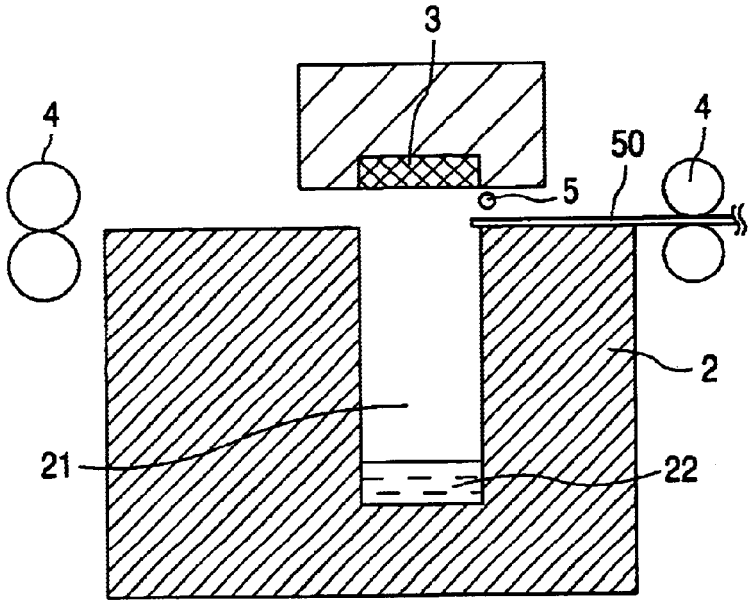
FIG. 9(a) (PRIOR ART)
FIGS. 9(*a*) and 9(*b*) are sectional views showing the structure of a conventional inkjet recording apparatus.
Figure 9B:
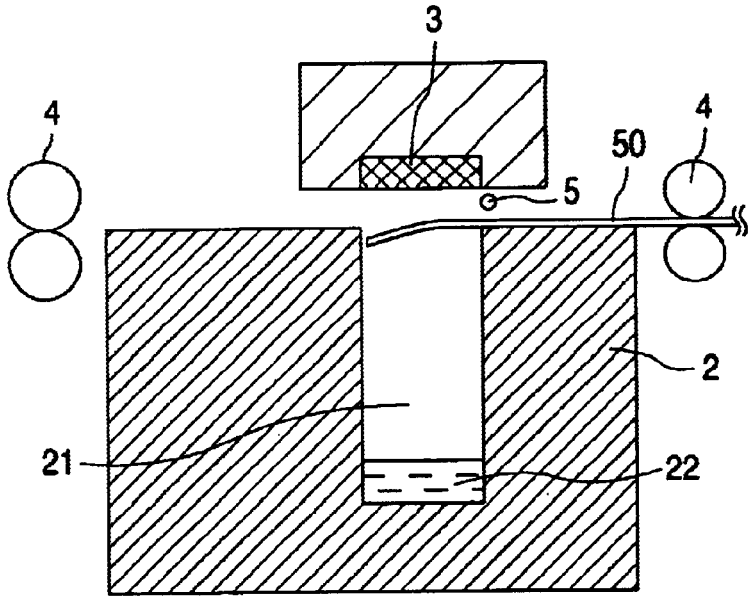
FIG. 9(b) (PRIOR ART)

Then as shown in FIG. 8(*a*), rotatable supporting member 101 is stored in notched section 102, until recording medium 50 is fed and detected by first sensor 111*a*, that is, until recording head 3 ejects ink on the surface of recording medium 50 and the borderless printing of the leading edge of recording medium 50 is completed.

Next, as shown in FIG. 8(*b*), when first sensor 111*a* detects the completion of the borderless printing by ink ejected from recording head 3 onto the recording surface, that is, the leading edge, of recording medium 50, rotatable supporting member 101 begins to move out of notched section 102.

Next as shown in FIG. 8(*c*), rotatable supporting member 101 supports recording medium 50, and allows recording medium 50 to arrive smoothly on the downstream surface of platen 2. Since supporting member 101 is formed such that the structure wherein the surface facing recording head 3 projects slightly, notched section 102 is formed by cutting into the surface of platen 2, and thereby a part of rotatable supporting member 101 appears above this cut-out section, and supported recording medium 50 can smoothly arrive at the downstream surface of platen 2.

After that the print is performed by the ink ejected from recording head 3 to the upstream side edge (that is, the trailing edge) of recording medium 50, and when borderless printing is performed on the trailing edge of recording medium 50, the control section controls rotatable supporting member 101 to be stored in notched section, based on the detected result of second sensor 111*b*, and the print is completed. The position of second sensor 111*b* is such that rotatable supporting member 101 is not exposed to the oversprayed ink during the borderless printing work on the trailing edge of recording medium 50.

As stated above, according to the platen and the inkjet recording apparatus of the present embodiment, since a rotatable supporting member is provided to support the recording medium, when the recording medium travels on the platen, the leading edge of the recording medium does not drop into the grooved section, and further it is possible to keep the distance between the recording head and the recording medium stable.

According to the platen and the inkjet recording apparatus using that platen in the present embodiment, since the notched section is formed by cutting into the surface of the platen, that is, the downstream side surface of the grooved section is notched, and further, since the shape and the setting position of the rotatable supporting member is structured in such a way that a part of the supporting member rises above the surface of the platen, therefore it is possible to convey the recording medium smoothly and precisely.

Further, according to the platen and the inkjet recording apparatus of the present embodiment, since there are provided sensors for controlling the supporting member such as the first sensor to detect the completion of the borderless printing work on the leading edge of the recording medium and the second sensor to detect the trailing edge of the recording medium, and control section for controlling the movement of the rotatable supporting member based on the detected results, rotatable supporting member is not inked by oversprayed ink, and as a result it is possible to solve the problem of the recording medium becoming dirty.

(The Third Embodiment)

The third embodiment of the present invention will now be explained, while referring to the drawings. Explanation of the third embodiment having a similar structure as those of the first and second embodiments described above will be eliminated.

Figure 10:
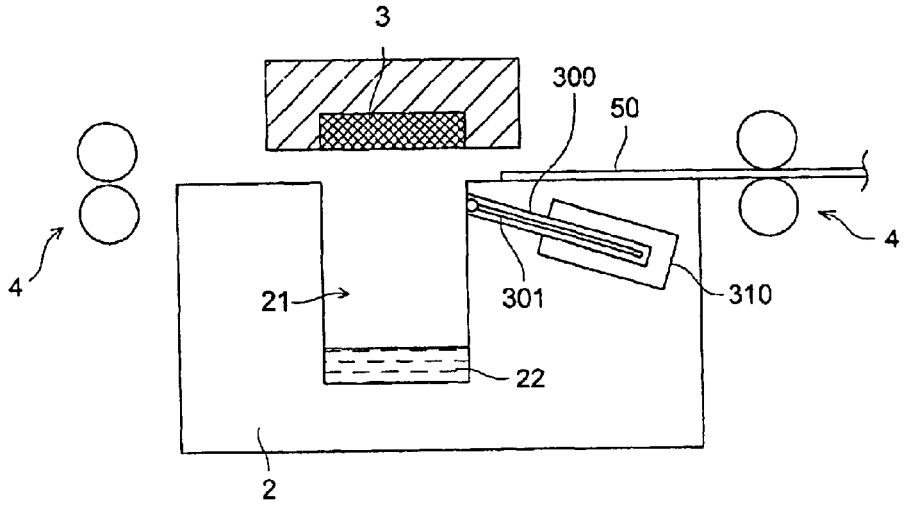
FIGS. 10(*a*)–10(*c*) are sectional views showing stages of the pushing member of the third embodiment.
Figure 10:
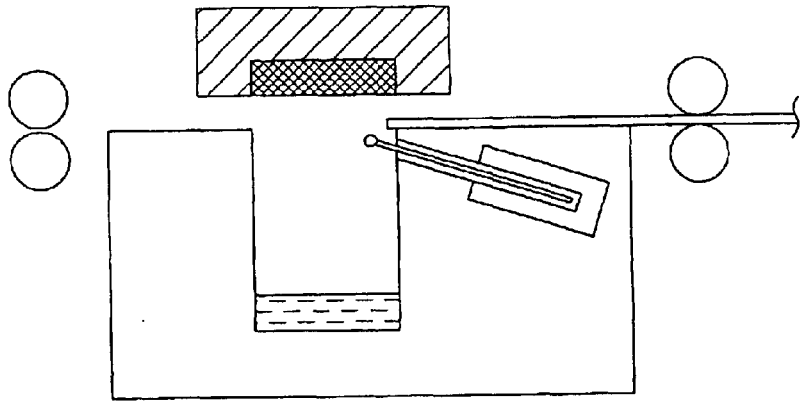
Figure 10:
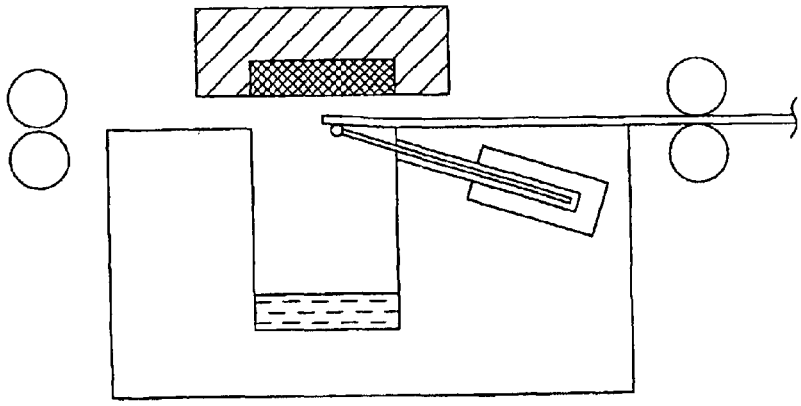
Figure 11:
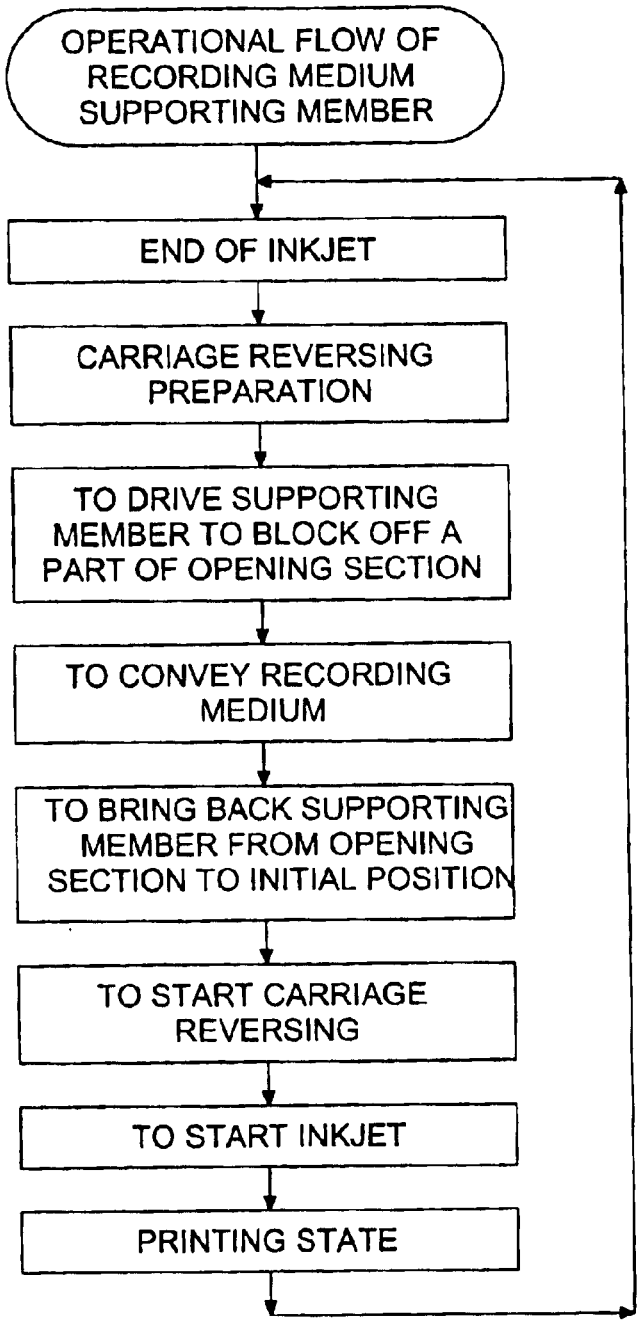
FIG. 11 is a flow chart showing stages of the pushing movement of the supporting member of the third embodiment of the present invention.

FIGS. 10(*a*)–10(*c*) are a sectional view in which a pushing member is used in the third embodiment, that is, the pushing member is comparable to the rotatable supporting member in the first and second embodiments.

As shown in FIGS. 10(*a*)–10(*b*), the structure of the third embodiment is different from the first and second embodiments, which is a pushing member instead of a rotatable supporting member, a different form of the notched section, and omission of the sensor for controlling the supporting member. Especially, pushing member 301 shaped like a stick is stored in notched section 300 as shown in FIG. 10(*a*). Solenoid 310 pushes and pulls pushing member 301. When pushing member 301 supports the recording medium, the top of pushing member 301 rises above the surface of the platen. Since a controller (not illustrated) using CPU controls the driving source of the conveyance of recording medium 50, solenoid 310, and input of the print starting sensor, it is possible to control the operations such as the pushing operation after the end of inkjet on the leading edge and before the conveyance of recording medium 50, and pulling operation after the conveyance of recording medium 50 and before the inkjet from the recording head, without need for a supporting member control sensor.

By the above structure, the recording medium is supported by the end of the pushing member which rises above the surface of the platen, and the recording medium can cross the grooved section and can precisely and smoothly arrive at the downstream side of the grooved section of the platen, as well as the case of the rotatable supporting member of the first and second embodiments. The recording medium is not spotted by stray ink, and further, a supporting member controlling sensor is not required.

(The Fourth Embodiment)

Figure 12:
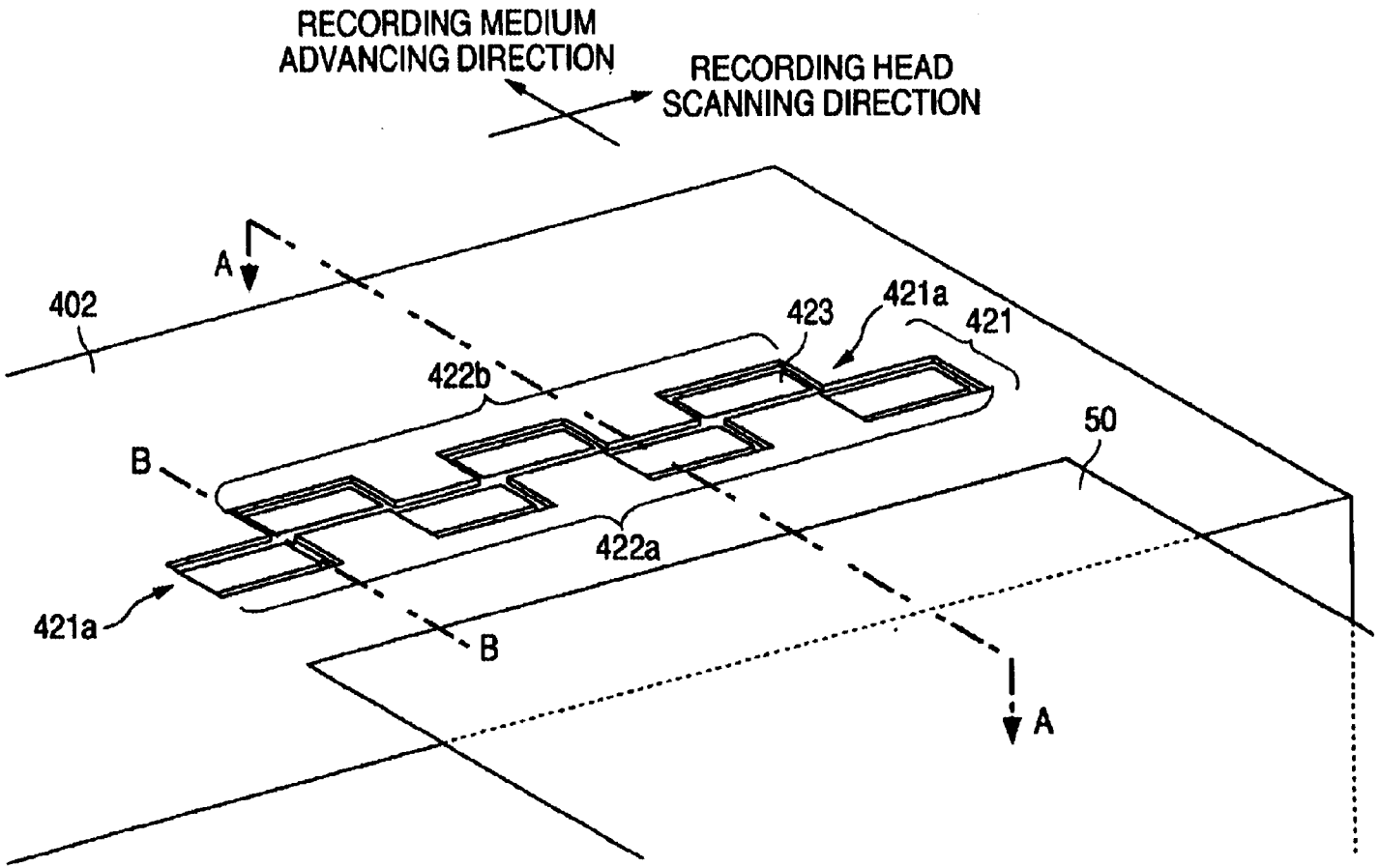
FIG. 12 is a perspective view showing the structure of the surface of the platen of the fourth embodiment of the inkjet recording apparatus of the present invention.

FIG. 12 is a sectional view showing the structure of a grooved sections formed on the surface of the platen of the embodiment of the present invention.

As shown in FIG. 12, grooved section 421 is composed of a first small grooved section array 422*a* including more than two first small grooved sections 421*a*, and second small grooved section array 422*b* including more than two second small grooved sections 421*b*, in the scanning direction of the recording head (not illustrated), on platen 402. First small grooved section array 422*a* is parallel to second small grooved section array 422*b*. Second small grooved section 421*b* connects both adjacent first grooved sections 421*a*. Further the suface on the platen between the first small grooved sections 421*a* functions a fixed supporting member, and the surface on the platen between the second small grooved sections 421*b* functions the fixed supporting member.

Stray ink absorbing members 423 in first small grooved sections 21*a* and second small grooved sections 421*b*, are arranged in such a way that the edges of each small grooved section, perpendicular to the recording head scanning direction, are collinear (FIG. 12, line B—B). In other words, the conventional grooved section is divided into three or more sections, and the divided sections are staggered corresponding with the above mentioned positions of the first and second small grooved sections 421*a* and 421*b*, in the feeding direction of recording medium 50.

Inkjet recording apparatus of the present invention will now be described referring to the drawings.

Figure 13A:
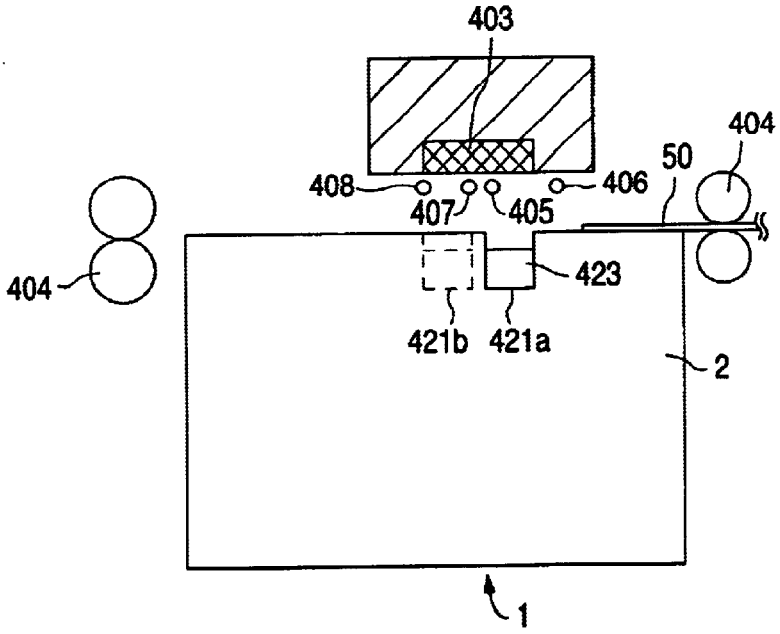
FIG. 13(*a*) is a sectional view showing the structure of the fourth embodiment of the inkjet recording apparatus of the present invention.
Figure 13B:
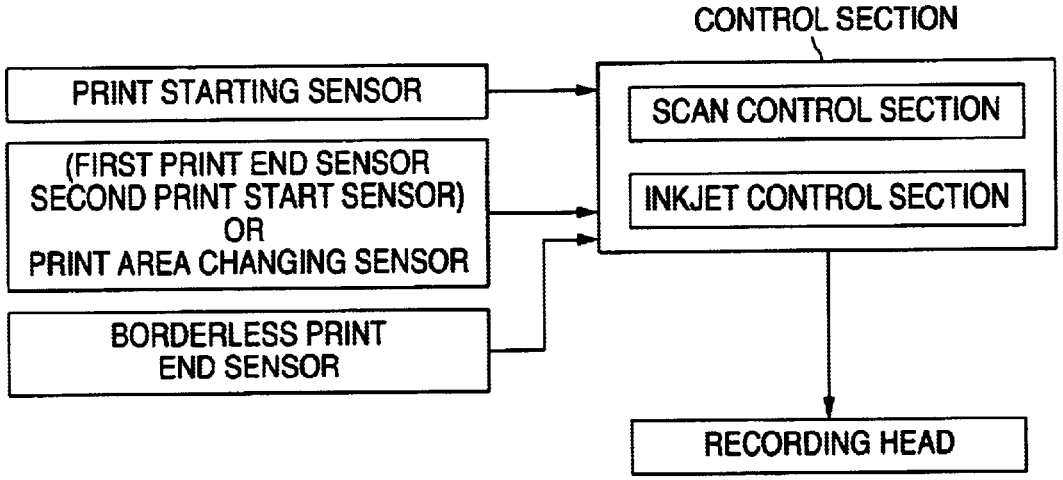
Figure 14:
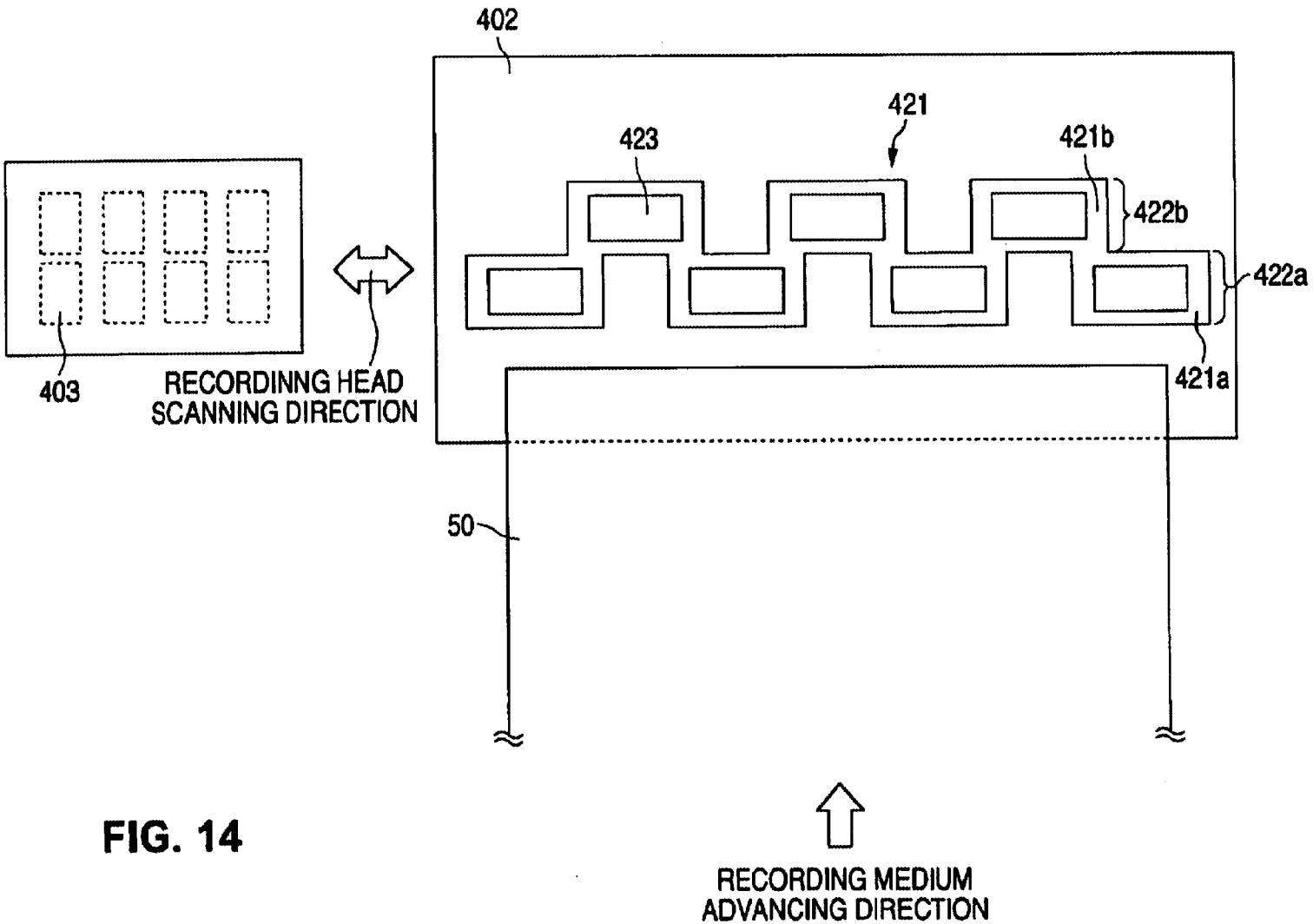
FIG. 14 is a top view showing the structure of the fourth embodiment of the inkjet recording apparatus of the present invention.

FIG. 13(*a*) is a section along line A—A in FIG. 12, and FIG. 13(*b*) is a block diagram showing the relationship among the sensors, the control section, and the recording head. FIG. 14 is a top view showing the positional relationship of the recording medium fed onto the platen and the grooved sections.

As shown in FIG. 13(*a*), inkjet recording apparatus of the present invention is composed of conveyance means 404 to convey recording medium 50, recording head 403, having a nozzle array to eject ink onto the recording surface of recording medium 50, and scanning recording medium 50 in parallel to the surface of recording medium 50 and perpendicular to the feeding direction of the recording medium 50, and platen 402, having grooved sections 421 on the surface facing recording head 403, for receiving any oversprayed ink and positioning recording medium 50.

Nozzle array installed in recording head 403 is divided into two stages, in the feeding direction of recording medium 50, and each is controlled separately. The divided areas are positioned in such a way that the oversprayed ink from one of the nozzle arrays falls onto stray ink absorbing member 423 in first small grooved section array 422*a*, and the oversprayed ink from the other nozzle array falls onto stray ink absorbing member 423 in second small grooved section array 422*b*.

Print starting sensor 405, which sends signals to start the borderless printing on recording medium 50, is provided on the inkjet recording apparatus of the present invention. Specifically, print starting sensor 405 is located where sensor 405 can detect recording medium 50, just before recording medium 50 arrives at grooved section 421, and the detected result is transferred to the control means (not illustrated). The control means is composed of a means to control the scanning work of recording head 403, and a means to control the ejection of ink. Thus, the apparatus starts the printing on the surface of recording medium 50.

Further, conveyance means 404 is provided to convey recording medium 50 to the surface of platen 402. Still further, conveyance means 404 has first borderless print completion sensor 406, which detects that the leading edge of the recording medium has completely covered small grooved section array 422*a*, second borderless print starting sensor 407, which detects that recording medium 50 has arrived at small grooved section array 422*b*, and borderless print completion sensor 408, which detects that the leading edge of recording medium 50 has completely covered second small grooved section array 421*b*. Further sensors 406, 407, and 408 are located where the ink ejection from the nozzle array is not disturbed.

In the cases where there is no clearance between first small grooved section array 422*a* and second small grooved section array 422*b* in the feeding direction of recording medium 50, it is possible provide a single sensor as a print area conversion sensor in which first borderless print completion sensor 406 and second borderless start sensor 407 are integrated.

Further, stray ink absorbing member 423 provided to absorb the ink oversprayed from recording head 403 is installed at the bottom of each small grooved section 421*a*. When grooved section 421 has no bottom, stray ink absorbing member 423 can form the bottom of grooved sections 421.

As shown in FIG. 13(*b*), the above-mentioned control means is composed of a means to control the scanning work of recording head 403 and a means to control the ink ejection. Control means controls recording head 403 and the nozzle arrays, based on the detected results of print starting sensor 405, first borderless end sensor 406, second borderless start sensor 407 (or print area conversion sensor), and borderless print completion sensor 408.

Still further, as shown in FIG. 14, the width of grooved section 421, that is, the width in the recording medium feeding direction, in which first small grooved section array and second small grooved section array exist, is set to be greater than the width of recording head 403, located on a head unit that scans above platen 402.

Next, the movement of the embodiment of the present invention will be described, while referring to the drawings.

Figure 15:
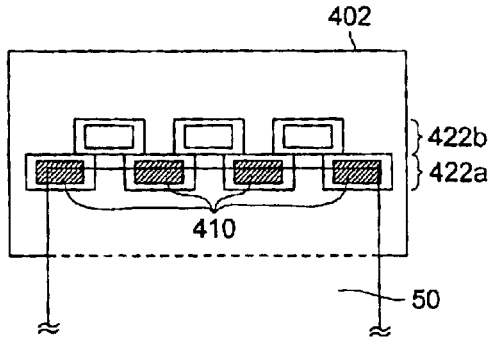
FIGS. 15(*a*)–15(*d*) are top views showing the operation of the fourth embodiment of the present invention.
Figure 15:
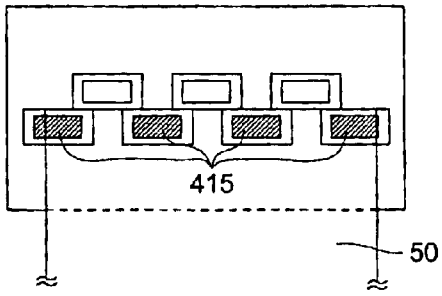
Figure 15:
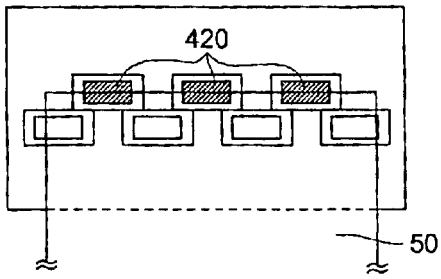
Figure 15:
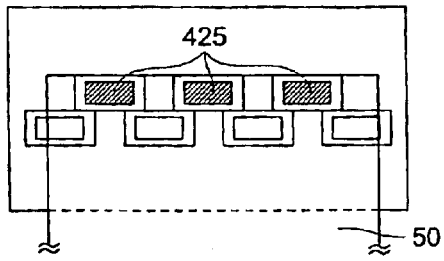
Figure 16:
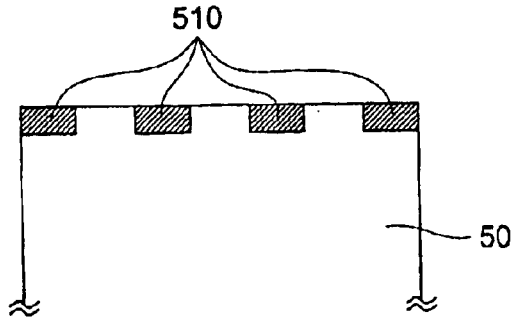
FIGS. 16(*a*)–16(*c*) are top views showing printed conditions on the recording medium of the fourth embodiment of the present invention.
Figure 16:
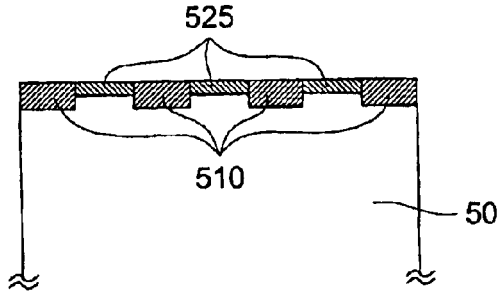
Figure 16:
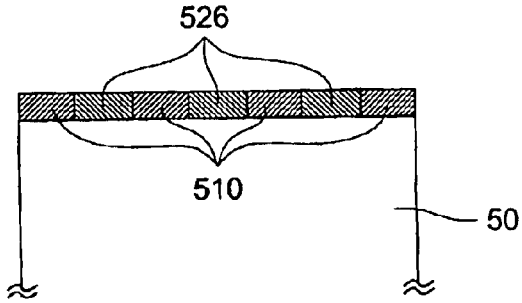
Figure 17:
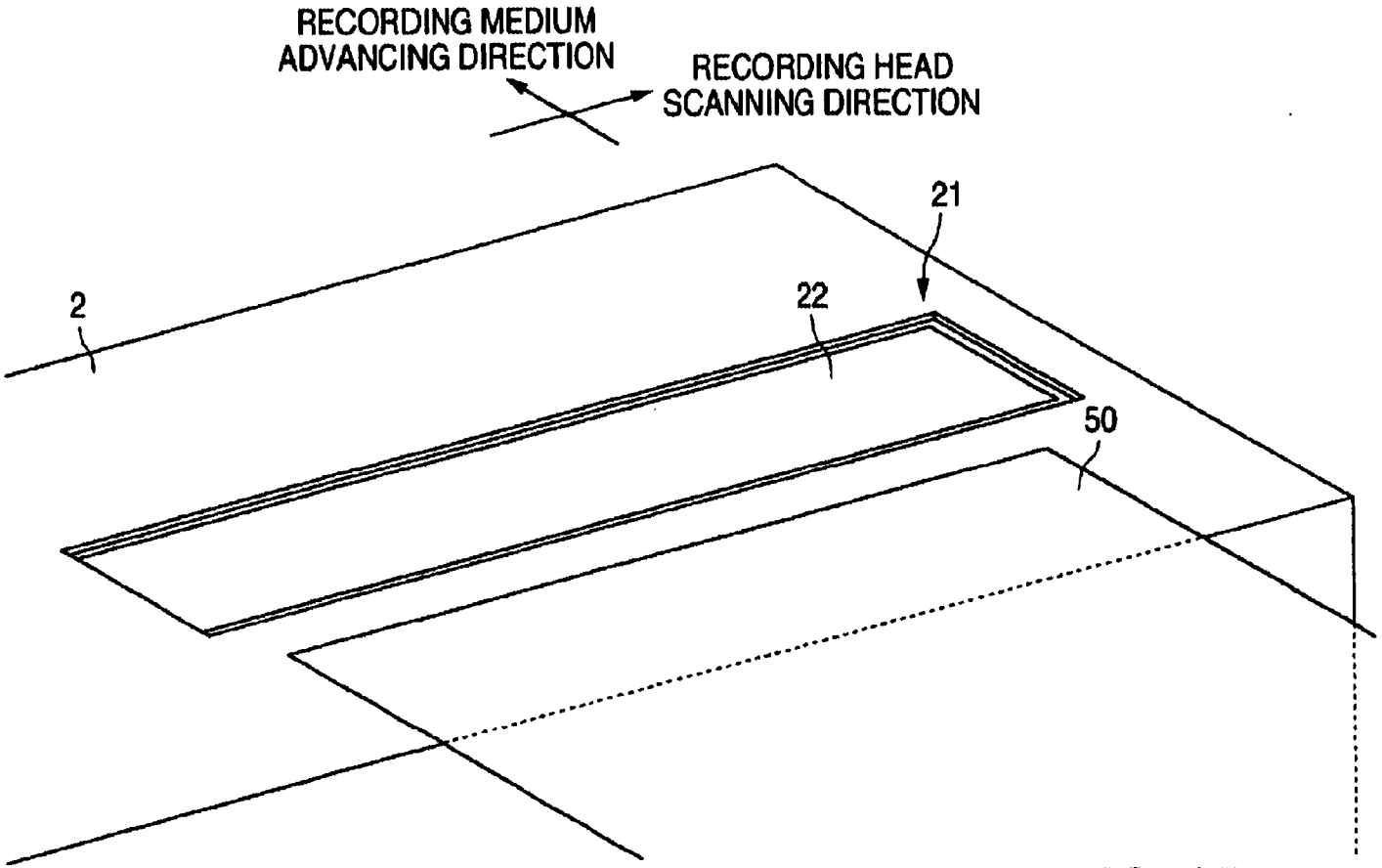
FIG. 17 (PRIOR ART)
FIG. 17 is a perspective view showing the structure of the surface of the platen of a conventional inkjet recording apparatus.

FIGS. 15(*a*)–15(*d*) are top views showing the stages of movement of the embodiment of the invention. FIGS. 16(*a*)–16(*c*) are top views showing the printed result on the recording medium by the movement shown in FIGS. 15(*a*)–15(*d*). FIG. 16(*a*) shows the printed result between FIG. 15(*a*) and FIG. 15(*b*). FIG. 16(*b*) shows the printed result between FIG. 15(*b*) and FIG. 15(*c*). FIG. 16(*c*) shows the printed result between FIG. 15(*c*) and FIG. 15(*d*).

As shown in FIG. 15(*a*), firstly, recording medium 50 is conveyed from the upstream side onto platen 402, and when print starting sensor 405 detects recording medium 50, nozzle array of recording head 403, which corresponds to first small grooved section array 422*a*, starts inkjet on the recording surface of recording medium 50.

During this time, the nozzle array, which corresponds to first small grooved section array 422*a*, is controlled to jet ink only into stray ink absorbing member 423 in first small grooved section array 422*a*, as shown by numeral 410 in FIG. 15(*a*), which is the first borderless print area.

Thus, printing by the nozzle array corresponding to first small grooved section 422*a* of recording head 403, is performed until first borderless print completion sensor 406 detects recording medium 50. The printed result on recording medium 50 is shown by "first borderless print result 510" in FIG. 16(*a*). Numeral 415 shows the completed first borderless print, and numeral 425 shows the completed second borderless print.

After that, as shown in FIG. 15(*c*), when conveyed recording medium 50 is detected by second borderless print starting sensor 407, the nozzle array of recording head 403, corresponding to first small grooved section array 422*a*, stops ink ejection onto the recording surface of recording medium 50, and the nozzle array of recording head 403, corresponding to second small grooved section array 422*b*, starts ink ejection onto the surface of recording medium 50.

In this time, the nozzle array, which corresponds to second small grooved section array 422*b*, is controlled to jet ink only into stray ink absorbing member 423 in second small grooved section array 422*b*, as shown by numeral 420 in FIG. 15(*a*), which means the second borderless print area.

In case that first borderless print completion sensor 406 and second borderless start sensor 407 are integrated into a single sensor as stated above, when conveyed recording medium 50 is detected, the nozzle array of recording head 403, corresponding to first small grooved section array 422*a*, stops ink ejection onto the recording surface of recording medium 50, and the nozzle array of recording head 403, corresponding to second small grooved section array 422*b*, starts ink ejection onto the recording surface of recording medium 50.

Thus, printing by the nozzle array corresponding to second small grooved section 422*b* of recording head 403, is performed until borderless print completion sensor 408 detects recording medium 50. The printed result on recording medium 50 is shown numeral 525 in FIG. 16(*b*), which means second borderless print result (under printing).

Thus, borderless printing is performed from the time when recording medium 50 is detected by print starting sensor 405 to the time when it is detected by borderless print completion sensor 408, and thereby the print is conducted on recording medium 50, shown by numerals 510 and 526 in FIG. 16(*c*). Numeral 510 designates the first borderless print result and numeral 526 designates the second borderless print result.

Then normal printing is performed, irrespective of the divided nozzle arrays, and borderless print on the trailing edge of recording medium 50 is performed by the nozzle control which is opposite to the control for borderless printing on the leading edge of recording medium 50.

As mentioned above, according to the inkjet recording apparatus of the present embodiment, since the downstream surface of the grooved section is formed cy cutting into the surface of the platen, when the recording medium slides over the platen, the leading edge of the recording medium can not drop into the grooved section, and further it is possible to maintain a stable distance between the recording head and the recording medium stable.

According to the inkjet recording apparatus of the present invention, since first borderless print completion sensor 406, second borderless print starting sensor 407 (or print area conversion sensor), and borderless print completion sensor 408 are provided based on the form of the grooved section, it is possible to perform very precise borderless printing, and also to prevent the reverse surface of the recording medium from being spotted by stray ink.

As for the other embodiments of this invention, stray ink absorbing member 423 can be inter-mutually connected.

Thus, the stray ink absorbing member is installed widely enough that the oversprayed ink can be effectively absorbed.

Further, it is possible to make the structure of the grooved section wherein the first small grooved section of the first small grooved section array and the second small grooved section of the second small grooved section array are expanded in the scanning direction of the recording head within a predetermined limit.

Embodiments of this invention have been explained as stated before, though the above descriptions disclose the embodiments, it is possible to change them within a predetermined range, and each embodiment can exemplify but cannot limit the invention.

As an effect of the present invention, according to the platen and the inkjet recording apparatus using the same, a supporting member which supports the conveyed recording medium is provided, and when the recording medium travels onto the platen, the leading edge of the recording medium does not fall into any grooved sections, and further, the distance between the recording head and the recording medium can be kept quite stable.

Still further, according to the platen and the inkjet recording apparatus using the same platen, the notched section is cut into the surface of the platen, and the downstream edge of the grooved section is notched, and the shape and the location of the supporting member is designed in such a way that a part of the supporting member appears above the surface of the platen, it is possible to convey the recording medium smoothly and precisely.

Still further, according to the platen and the inkjet recording apparatus of the present invention, provided are a first sensor to detect completion of borderless printing on the leading edge of the recording medium, a second sensor to detect the trailing edge section of the recording medium, and a control section to control movement of the supporting member, based on the detected results of the first and second sensors, and therefore, the supporting member is not stained by oversprayed ink, and thereby the recording medium is not spotted by stray ink.

What is claimed is:

1. A platen on which a recording medium advances, of an inkjet recording apparatus, comprising:

a grooved section formed in a direction perpendicular to a feeding direction of the recording medium on the platen, to receive oversprayed ink jetted onto the recording medium from a recording head; and a supporting member which moves up to a supporting position and supports the recording medium when the recording medium crosses over the grooved section, wherein the supporting member prevents the recording medium from falling into the grooved section and maintains a stable distance between the recording medium and the recording head.

2. The platen of the inkjet recording apparatus of claim 1, further comprising:

a notched section to house the supporting member in the grooved section, and to prevent the supporting member from being stained by oversprayed ink.

3. The platen of the inkjet recording apparatus of claim 2, wherein the notched section is formed to be cut into a surface of the platen.

4. The platen of the inkjet recording apparatus of claim 1, wherein when the supporting member moves up to the supporting position, the supporting member rises above the surface of the platen.

5. The platen of the inkjet recording apparatus of claim 2, wherein the notched section is formed in inner walls of the grooved section.

6. The platen of the inkjet recording apparatus of claim 1, further comprising:

an oversprayed ink absorbing section at a bottom of the grooved section.

7. An inkjet recording apparatus, comprising:

a grooved section formed in a direction perpendicular to a feeding direction of a recording medium a platen, to receive oversprayed ink jetted onto a recording medium from a recording head; and a supporting member which moves up to a supporting position and supports the recording medium when the recording medium crosses over the grooved section, wherein the supporting member prevents the recording medium from falling into the grooved section and maintains a stable distance between the recording medium and the recording head.

8. The inkjet recording apparatus of claim 7, further comprising:

a notched section to house the supporting member in the grooved section, and to prevent the supporting member from being stained by oversprayed ink.

9. The inkjet recording apparatus of claim 8, wherein the notched section is formed to be cut into a surface of the platen.

10. The inkjet recording apparatus of claim 8, wherein the notched section is formed in inner walls of the grooved section.

11. The inkjet recording apparatus of claim 8, further comprising:

an oversprayed ink absorbing section at a bottom of the grooved section.

12. The inkjet recording apparatus of claim 7, wherein when the supporting member moves to a position to support the recording medium, the supporting member rises above the surface of the platen.

13. The inkjet recording apparatus of claim 7, further comprising:

a first sensor to detect completion of a borderless printing on a leading edge of the recording medium;

a second sensor to detect a trailing edge of the recording medium; and a control section to control conveyance of the recording medium based on detected results of the first sensor and the second sensor.

14. The inkjet recording apparatus of claim 7, wherein the supporting member moves up to a supporting position and closes at least a part of the grooved section before the recording medium is fed, and allows the recording medium to cross over the grooved section, and the supporting member moves down to the notched section after the completion of feeding of the recording medium and opens the grooved section.

* * * * *